US007036666B2

(12) United States Patent
Hammett

(10) Patent No.: US 7,036,666 B2
(45) **Date of Patent: *May 2, 2006**

(54) BEVERAGE TRAY WITH DE-STACKING PADS AND IMPROVED STACKING DETENTS

(75) Inventor: Roy Hammett, Odessa, FL (US)

(73) Assignee: Norseman Plastics, LTD, Reydale (CA)

( * ) Notice: Subject to any disclaimer, the term of this patent is extended or adjusted under 35 U.S.C. 154(b) by 17 days.

This patent is subject to a terminal disclaimer.

(21) Appl. No.: 10/254,224

(22) Filed: Sep. 25, 2002

(65) Prior Publication Data

US 2003/0024844 A1 Feb. 6, 2003

Related U.S. Application Data

(63) Continuation-in-part of application No. 29/141,522, filed on May 8, 2001, now Pat. No. Des. 469,255.

(51) Int. Cl.
*B65D 21/00* (2006.01)
*B65D 85/62* (2006.01)

(52) U.S. Cl. ..... 206/503; 206/519; 220/509

(58) Field of Classification Search ..... 220/519, 220/516, DIG. 15, 509; 206/503, 519
See application file for complete search history.

(56) References Cited

U.S. PATENT DOCUMENTS

| | | | | |
|---|---|---|---|---|
| 3,333,727 | A * | 8/1967 | Belcher et al. | 206/509 |
| 3,347,405 | A * | 10/1967 | Motsenbocker et al. | 220/516 |
| 4,410,099 | A * | 10/1983 | deLarosiere | 220/516 |
| 5,979,654 | A * | 11/1999 | Apps | 206/507 |
| D469,255 | S * | 1/2003 | Hammett | D3/314 |

* cited by examiner

*Primary Examiner*—Nathan J. Newhouse
*Assistant Examiner*—Harry Grosso
(74) *Attorney, Agent, or Firm*—Dennis H. Lambert

(57) ABSTRACT

A beverage tray has a floor with peripheral, upstanding side and end walls for holding a plurality of containers of beverage, for example in six-packs. The floor has a plurality of downwardly projecting detents on its bottom surface for cooperation with the tops of beverage containers in a sub-adjacent tray to impede free sliding movement of an upper tray over the beverage containers in a sub-adjacent tray to enable stable stacking of the trays, while at the same time enabling the upper tray to be slid over the cans in the lower tray to remove the upper tray from a stack of trays. The detents are rectilinear and present spaced, opposed, parallel, straight detents that define detent sets surrounding bottle top receiving areas. The upper edge of the side wall is smoothly sinusoidally curved to define spaced, alternating upper side wall sections and recessed areas. The side wall has an inwardly inclined, planar outer side wall panel, and a plurality of flat pads are on the outer side wall panel for cooperation with automated machinery used in the handling of the tray.

25 Claims, 12 Drawing Sheets

BEVERAGE TRAY WITH DE-STACKING PADS AND IMPROVED STACKING DETENTS

This application is a continuation-in-part of prior design patent application Ser. No. 29/141,522, filed May 8, 2001, now U.S. Pat. No. D469,255 issued Jan. 28, 2003, and entitled Beverage Tray.

BACKGROUND OF THE INVENTION

1. Technical Field

This invention relates to packaging, and particularly to packaging for containers of beverage. More specifically, the invention relates to trays or crates for holding containers of beverage during storage, shipment and handling, with structure on the sidewalls for machine handling, especially during de-stacking of the trays, and with unique detent means on the bottom to achieve stability when trays loaded with beverage containers are stacked, but which enable a tray to be easily removed from the stack when desired.

2. Prior Art

Beverages, e.g., beer and soft drinks, are commonly packaged in cans or bottles. These cans and bottles, especially in sizes up to about sixteen ounces, are frequently bundled in groups, e.g., six-pack cartons, for marketing to consumers. To facilitate handling, whether bundled together in pre-packaged groups or left loose, the cans and bottles are usually placed in trays holding up to twenty-four containers of beverage, depending upon the size of the containers.

Reusable molded plastic trays capable of holding twenty-four half-liter containers of beverage, e.g., four six-packs, have been developed. One prior art tray construction for half liter bottles, for example, has low depth side walls with cut-outs through which the sides of the beverage containers are visible, and a tray bottom with detent means projecting below the bottom surface of the tray for cooperative engagement with the tops of beverage containers in a sub-adjacent tray to provide stability to a stack of trays, while at the same time enabling the trays to be moved laterally with respect to one another when it is desired to remove a tray from the stack. Conventional detent means are usually curvilinear, with opposing convex and/or concave surfaces that engage the tops of beverage containers in a sub-adjacent tray. Depending upon the orientation of one tray on top of another, and the position of the beverage container tops relative to these curvilinear detent means, a ragged, intermittent resistance to movement of the tray can be encountered when it is slid laterally over the top of a lower tray.

Features are also provided in prior art trays to enable nestable stacking of empty trays without shingling or wedging together of the trays. Thus, the sidewalls of the tray may be configured to have upwardly extending tapered projections that nest into hollow cavities in the bottom of the wall of a superposed tray when trays are stacked on top of one another.

Ergonomic handle designs are also provided in prior art trays to facilitate handling of the trays, and the floors and walls of the trays are designed to maximize strength while minimizing the use of materials in the manufacture of the tray.

To minimize manual labor in the handling of trays, various machinery has been developed for automated handling. For example, de-nesting machinery has been designed for automated unstacking of empty trays. These machines have mechanisms that engage and grip outer surface portions of the trays for moving them. Conventional trays must be designed with this in mind. Thus, to facilitate use with these machines, conventional trays may have flat, vertical outer sidewall surfaces for cooperation with the gripping mechanism on the machine. In a low depth nestable tray, this requirement for machine cooperation somewhat limits the flexibility and choice of designs used in the tray, especially in the sidewall.

An example of a prior art nestable display tray or crate for bottles is disclosed in U.S. Pat. No. 5,979,654. In this patent, the sidewalls comprise lower wall portions having a continuous, flat, vertical outer surface perpendicular to the plane of the bottom of the tray, and tapered upper wall portions projecting upwardly from the lower wall portion for nesting engagement in the bottom of the hollow sidewalls of a superposed tray. Curvilinear detent means project below the tray floor to achieve stability in a stack of trays loaded with beverage containers. The side wall, itself, in this patent has a straight, vertical outer surface that can cooperate with de-stacking machinery, and the detents means projecting below the bottom of the tray has opposed concave surfaces for cooperation with the tops of beverage containers in a lower tray.

Accordingly, there is need for a beverage tray having separate means incorporated therein for cooperation with automated machinery, thereby providing greater flexibility in the design of the tray sidewalls, and which includes detent means with opposed parallel rectilinear surfaces projecting from its bottom for smooth sliding movement of the tray past the tops of beverage containers in a lower tray.

SUMMARY OF THE INVENTION

The beverage tray of the present invention has separate means incorporated therein for cooperation with automated machinery, thereby providing greater flexibility in the design of the tray sidewalls, and includes detent means with opposed parallel rectilinear surfaces projecting from its bottom for smooth sliding movement of the tray past the tops of beverage containers in a lower tray.

The tray of the invention is a low depth, economical, molded plastic tray with opposite side walls and opposite end walls, and a bottom wall. The side walls and end walls are uniquely configured and have discrete areas integrated into them for cooperation with the gripping mechanism on automated machinery for handling the trays, and especially for de-stacking machinery.

The bottom wall is an open grid design that defines a flat planar upper surface, and a lower surface with sets of downwardly projecting detents defining twenty-four bottle top receiving areas spaced over the bottom surface of the tray for cooperative engagement with the tops of beverage containers in a sub-adjacent tray to provide stability to a stack of trays, while at the same time enabling the trays to be relatively easily and smoothly moved laterally with respect to one another when it is desired to remove a tray from the stack. The detents are rectilinear and present elongate, spaced apart, opposed parallel surfaces for sliding contact with the beverage container tops.

The detents are designed to form a plurality of first unobstructed open channels free of detents extending laterally through each side edge from a first line of uninterrupted detents lying along the longitudinal center of the tray bottom, and a plurality of second unobstructed open channels free of detents extending longitudinally through each end edge of the tray from respective second and third lines of uninterrupted detents extending transversely of the tray and spaced inwardly from each end of the tray about one-third the length of the tray.

The first line of detents forms a continuous detent that extends completely along the longitudinal centerline of the tray, and the second and third lines of detents also each forms a continuous detent extending along lines spaced equidistantly on opposite sides of the transverse centerline of the tray.

A fourth line of spaced detents extends along the transverse centerline of the tray, and fifth and sixth lines of spaced detents extend along transverse lines lying between a respective one of the second and third lines of detents and the adjacent end of the tray. The second, third, fourth, fifth and sixth transverse lines of detents are spaced equidistantly from one another.

The detents present straight line surfaces to the tops of bottles in a lower container when the trays are stacked on top of one another, in contrast to curvilinear detents which present curved surfaces to the bottle tops. For some orientations of one case stacked on top of another case loaded with bottles, curved detent surfaces would present opposed concave surfaces that could engage spaced bottle tops to cause rough or uneven movement of a tray when that tray is slid laterally to remove it from the stack. The straight detent surfaces on adjacent opposed detents of the present invention extend parallel to one another and do not pose these potential problems of prior art trays that have curvilinear detents.

With the detent structure of the invention, trays can be stacked parallel to one another, or in cross-stacked relationship, and at least some bottle tops in a sub-adjacent tray will be engaged behind one or more detents to prevent free, unintended sliding movement of one tray over another. At the same time, enough open channels will be defined for sliding movement of bottle tops along the tray bottom to enable relatively easy sliding movement when desired, whether the trays are stacked in parallel relationship, or cross-stacked, and whether they are pulled laterally to one side, or endwise from a stack. Moreover, the opposed, parallel straight detent surfaces establish opposed parallel boundaries to the bottle top receiving areas or pockets, avoiding situations in which bottle tops may experience rough, intermittently blocked movement when the tray is slid laterally to remove it from a stack of trays.

It will also be noted that the recessed areas defined on the underside of the tray bottom between the downwardly projecting detents are each larger than a closure diameter, whereby no single recessed area is capable of aligning that closure with respect to a bottle seating area. A plurality or all of the recessed areas cooperating simultaneously with a plurality of closures in a subjacent tray function to align stacked trays.

Each side wall has a substantially continuous, inwardly inclined planar outer surface extending from the bottom to the top. The top edge of each side wall is smoothly and uniformly sinusoidally curved, defining spaced, tapered, upper side wall sections separated by deep recesses or cut-outs through which the sides of beverage containers in the tray are visible. Each side wall has an inner side wall panel only on the upper side wall sections, whereby there is no inner side wall panel adjacent the floor of the tray. The inner side wall panels on the upper side wall sections are also substantially co-planar, but extend essentially perpendicularly with respect to the plane of the bottom wall.

In a preferred embodiment, the outer shoulder of the endmost upper side wall section is truncated to accommodate machinery on the filling line.

The end walls similarly have an inwardly inclined outer end wall panel, and a substantially planar inner end wall panel that is perpendicular to the plane of the tray floor. The top edge of the end walls is recessed at the opposite side edges thereof, and a slightly deeper recess is formed in the center of each end wall, extending over a substantial mid-portion of each end wall. These recesses define a pair of end wall pillars, or upper end wall sections, on each end wall.

A handle extends between the tops of the pillars at each tray end wall, extending over a substantial portion of the length of the tray end wall and slightly outwardly offset relative to the end wall. The inner end wall panel defines a connecting web that joins each end of the tray floor with the respective end walls adjacent opposite ends of the handles.

The outer end wall panels are omitted in the area beneath the handles, and both the side walls and the end walls are open along their bottom edges and are hollow, whereby when a plurality of trays are nested together the top edges of the upper side and end wall sections in a lower tray extend upwardly into the bottoms of the side and end walls of an upper tray.

During machine handling of trays, and especially during use of a de-stacking or de-nesting machine, the machine has portions that grip the outside of the tray to hold it and manipulate it. To facilitate this machine handling, the tray of the invention has several spaced, strategically placed, generally rectangular pads on the outer side and end wall surfaces, with the outer surfaces of the pads being substantially flat and lying in a plane that is substantially perpendicular to the plane of the tray floor. More specifically, a pad is formed on the outer surface of each side wall at the location of the upstanding side wall sections, and the pads extend upwardly from the bottom of the tray to approximately mid-height of the upstanding side wall sections. A similar pad is also formed on each end wall in the area beneath the cut-outs, extending upwardly from the bottom edge of the end wall to the bottoms of the cut-outs. The outer surface of the handle is built outwardly to define a further pad extending over substantially the entire outer surface of the handle. Accordingly, the outer surface of each side wall and of each end wall has three flat pads to facilitate handling with automated machinery.

The arrangement of pads on the outer surface of the tray side walls to facilitate handling with automated equipment lends greater flexibility to the design of the tray, and especially to the design of the tray side and end walls.

The foregoing and other advantages are provided in a tray that is economical to produce and which greatly facilitates the handling of the trays. The tray of the invention thus overcomes a significant shortcoming of conventional trays, and in addition provides other features and advantages.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
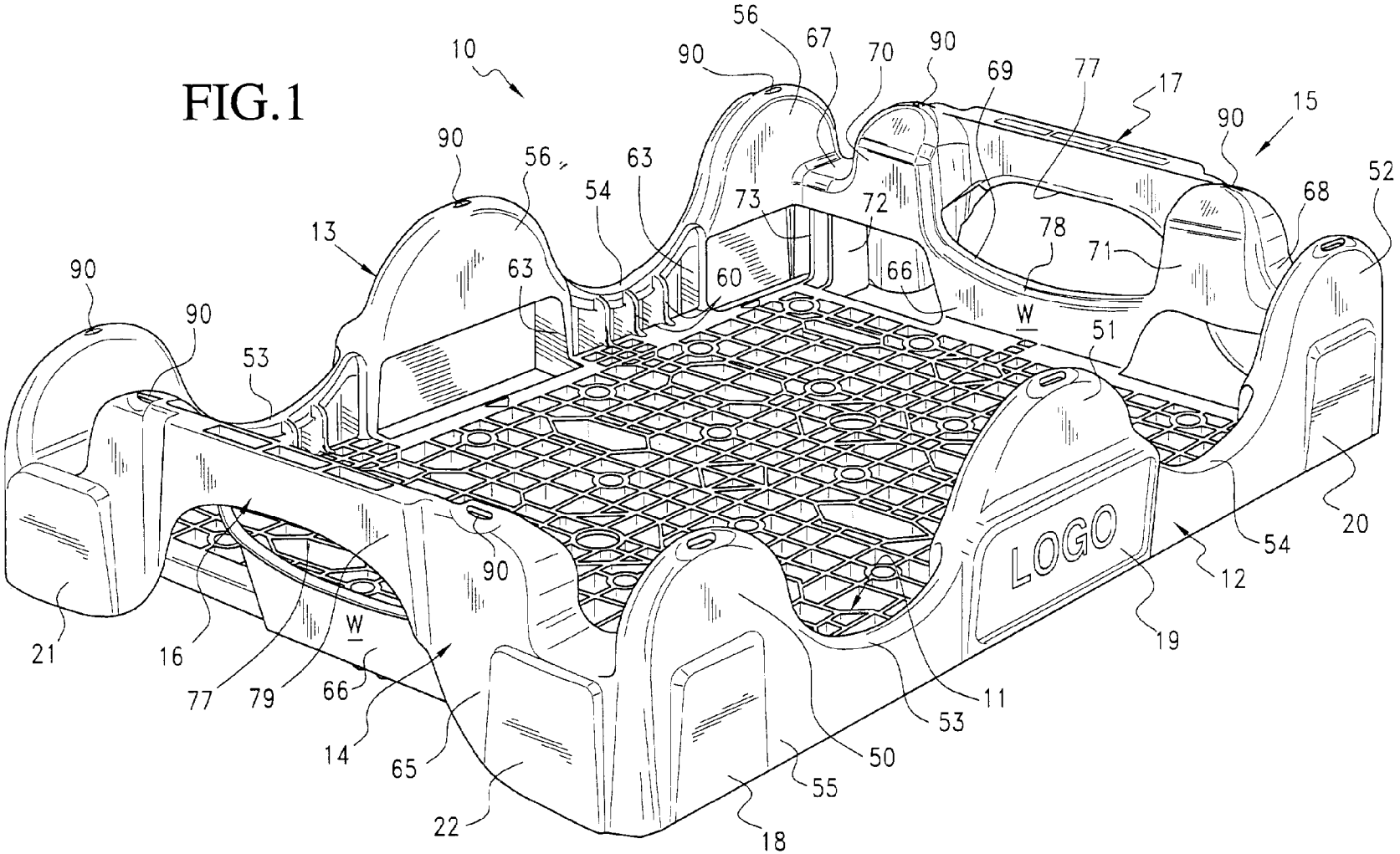
FIG. 1 is a top perspective view of the beverage tray according to the invention.

A preferred embodiment of the tray of the present invention is indicated generally at 10 in FIGS. 1–6. The tray comprises a bottom 11 having upstanding sinusoidally shaped side walls 12 and 13 extending along opposite sides, and opposite end walls 14 and 15 extending along opposite ends. Ergonomic handles 16 and 17 are formed on the opposite ends for handling the tray. Pads 18, 19, 20, and 21 and 22 are formed at strategic locations on the outer surfaces of the side and end walls, respectively, for cooperation with automated machinery (not shown) used in de-stacking the trays. Rectilinear sets of detents 23 project downwardly from the bottom of the tray floor to define bottle top receiving pockets that cooperate with the tops of bottles in a lower tray to impede free sliding movement of an upper tray over a lower tray in a stack of trays, and thereby lend stability to a stack of trays, but which permit relatively free, smooth sliding movement of the tray when it is desired to remove it from the stack.

Although at least some of the concepts of the present invention could be incorporated in trays for holding either bottles or cans, the tray as specifically described and illustrated herein is intended for use with half liter bottles, and is especially adapted for holding four six-packs of such bottles.

The tray may have a width-to-length relationship of 2:3, and be adapted to hold four bottles or cans across its width and six bottles or cans along its length, for a total of twenty-four bottles or cans, whether packaged loose in the tray or in pre-packaged six-pack cartons. For instance, four six-pack cartons can be placed in the tray. It should be understood, however, that the principles of the invention, or at least some of them, could be incorporated in trays having different dimensional relationships and capacities for holding different numbers of bottles or cans.

The floor 11 is formed by a plurality of longitudinally and transversely extending intersecting struts 24 and 25. The struts define an open grid-like structure that is lightweight and requires less material in the manufacture of the tray. Further, this open grid-like configuration provides drainage for any liquids or other debris that may fall into the tray. The top surface of the floor of the tray is relatively flat and unobstructed and, as noted, is adapted to hold up to four six-pack cartons, for example.

The struts support short cylindrical members 26 in locations corresponding to those areas on which individual bottles or cans would be seated and supported when placed in the tray, and also generally correspond to the locations of the bottle top receiving areas on the bottom surface of the tray floor. These cylindrical members are flush at their top and bottom ends with the top and bottom surfaces of the struts, and thus with the top and bottom surfaces of the tray floor.

The sets of downwardly projecting detents 23 on the underside of the tray floor are formed by increasing the depth or top-to-bottom dimension of selected struts and spaced rectilinear structures supported by the struts, so that the lower edges of the selected struts and rectilinear structures extend a short distance below the bottom surface of the tray floor. These detents are positioned and arranged to contact the tops of bottles in a lower tray and prevent uninhibited free sliding movement of an upper tray over a lower tray, thus providing stability to a stack of trays loaded with bottles. The struts and rectilinear structures define opposed, straight parallel detent surfaces around the pockets.

More specifically, the lower edges of a pair of closely spaced, parallel, adjacent struts 27 and 28 extending along the longitudinal center of the tray floor project below the bottom surface of the floor, and these struts are intersected at five uniformly spaced locations by diamond shaped formations 29 which have their lower edges coplanar with the lower edges of the struts 27 and 28. Those portions 30 of the transversely extending struts that extend between the longitudinal struts 27 and 28 are also increased in the top-to-bottom dimension so that their lower edges are coplanar with the lower edges of the struts 27 and 28. This formation, including the struts 27, 28 and 30, and the diamond shaped formations 29, define a continuous longitudinal center detent 31 that extends completely along the bottom of the tray floor from one end to the other.

Similarly, pairs of closely spaced, parallel, transversely extending struts 32, 33 and 34, 35, intersected by rectilinear formations 36 and 37, together with aligned diamond shaped formations 29, define continuous downwardly projecting transverse detents 38 and 39 extending across the width of the tray bottom at locations spaced slightly less than half way between the transverse centerline and the adjacent end of the tray.

A plurality of spaced, downwardly projecting rectilinear detents 40 and 41 extend along the transverse centerline of the tray, with the detents 40 and 41 located approximately equidistantly from adjacent circular members 25 in the bottle top receiving areas or pockets, or, in other words, represent areas on which the tops of containers in a lower tray would contact the bottom of the tray floor in an upper tray. Longitudinally extending open areas or paths "A" are defined between the spaced detents 40 and 41 (see FIGS. 2 and 6), through which the tops of bottles in a lower tray can freely slide when the tray is moved longitudinally over the bottles in a lower tray.

Substantially identical sets of downwardly projecting, spaced rectilinear detents 40*a* and 41*a*, and 40*b*, 41*b*, lie along transverse lines located between respective adjacent ends of the tray and adjacent continuous transverse detents 38 and 39, and are spaced the same distance from the detents 38 and 39 that the detents 38 and 39 are located from the detents 40 and 41 lying on the transverse centerline of the tray.

Figure 2:
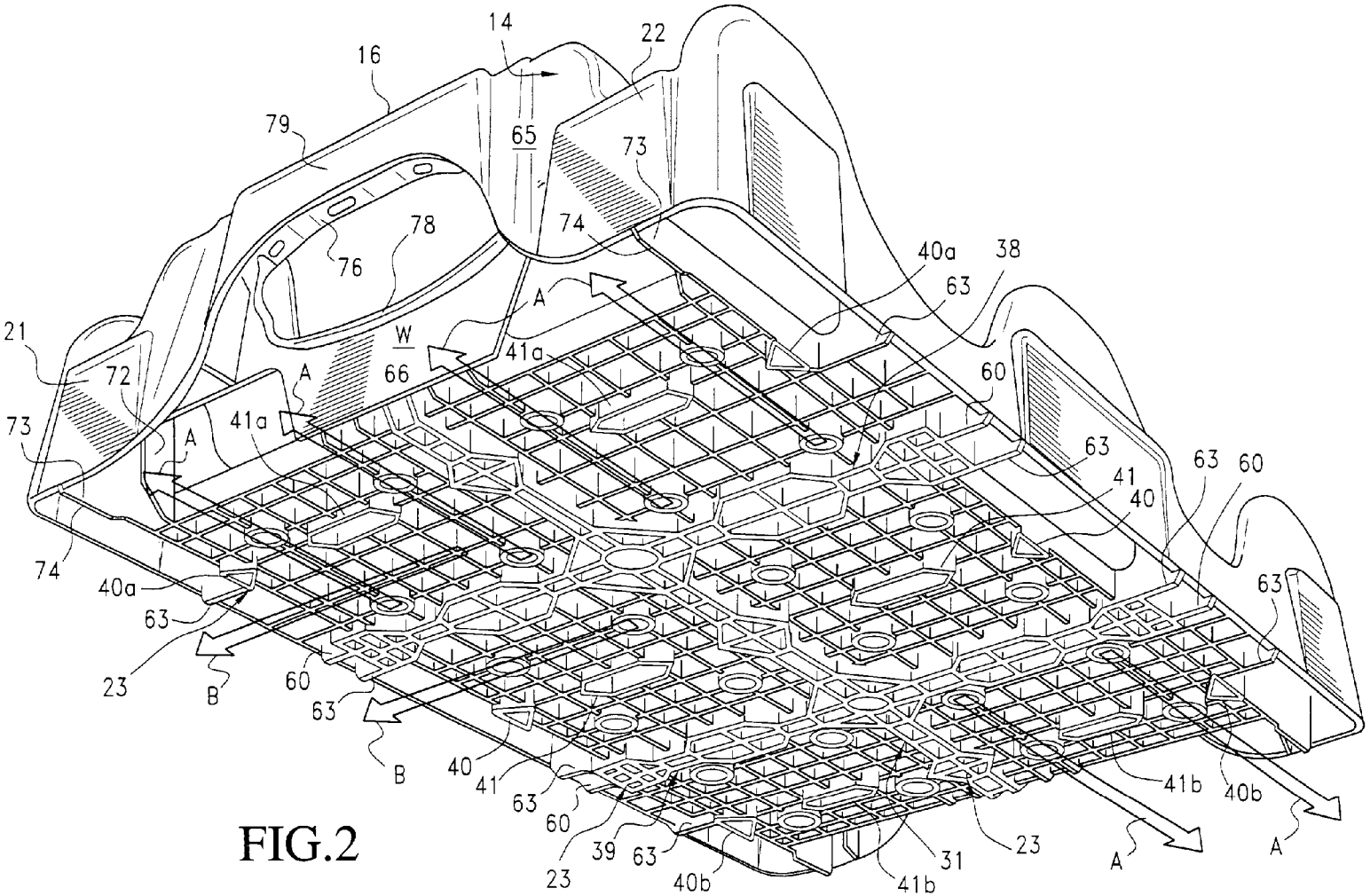
FIG. 2 is a bottom perspective view thereof, with portions highlighted to show the detents that project below the plane of the tray bottom for cooperation with the tops of beverage containers in a lower tray when the trays are stacked on top of one another.
Figure 3:
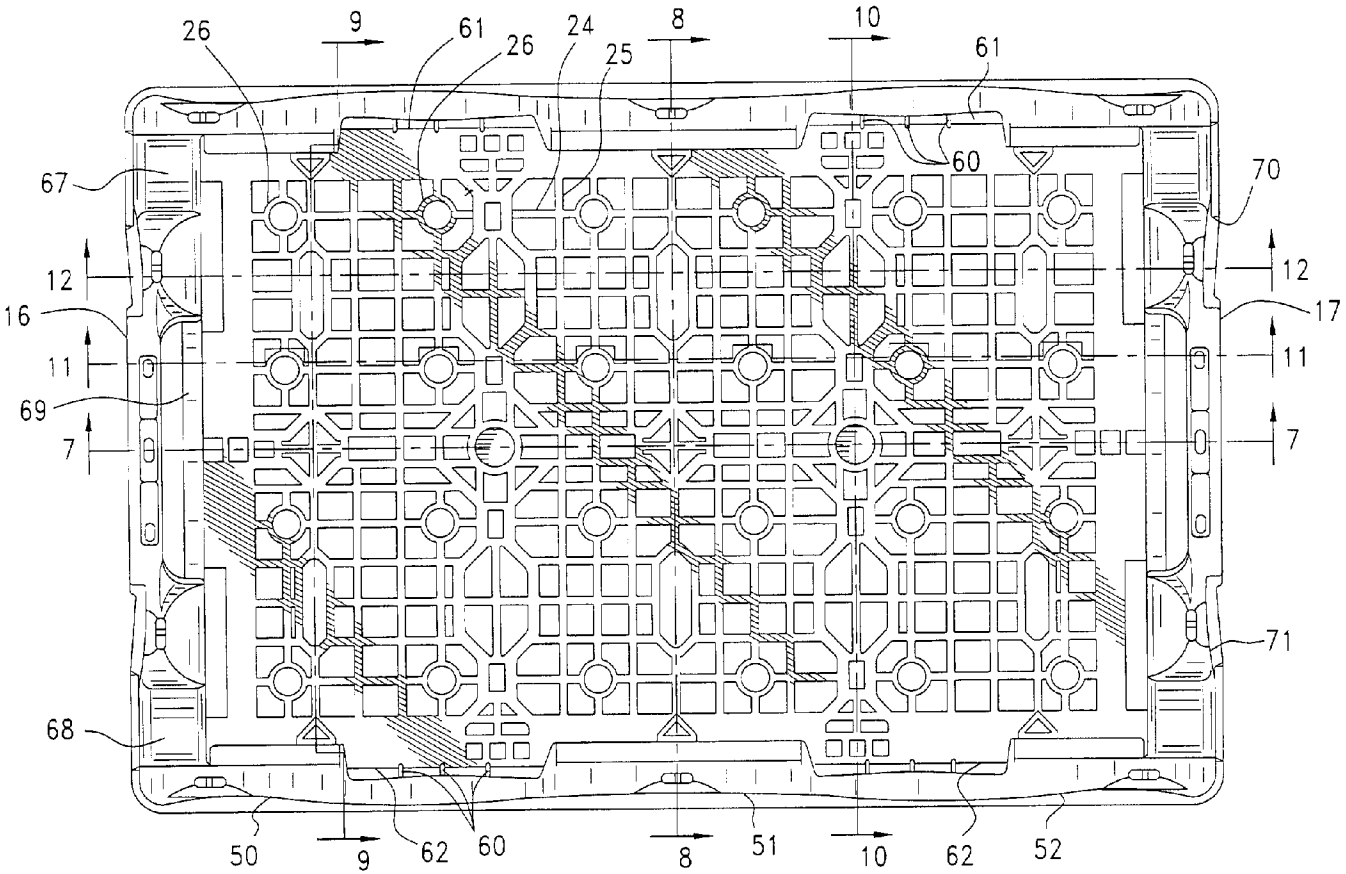
FIG. 3 is a top plan view of the tray of the invention.
Figure 4:
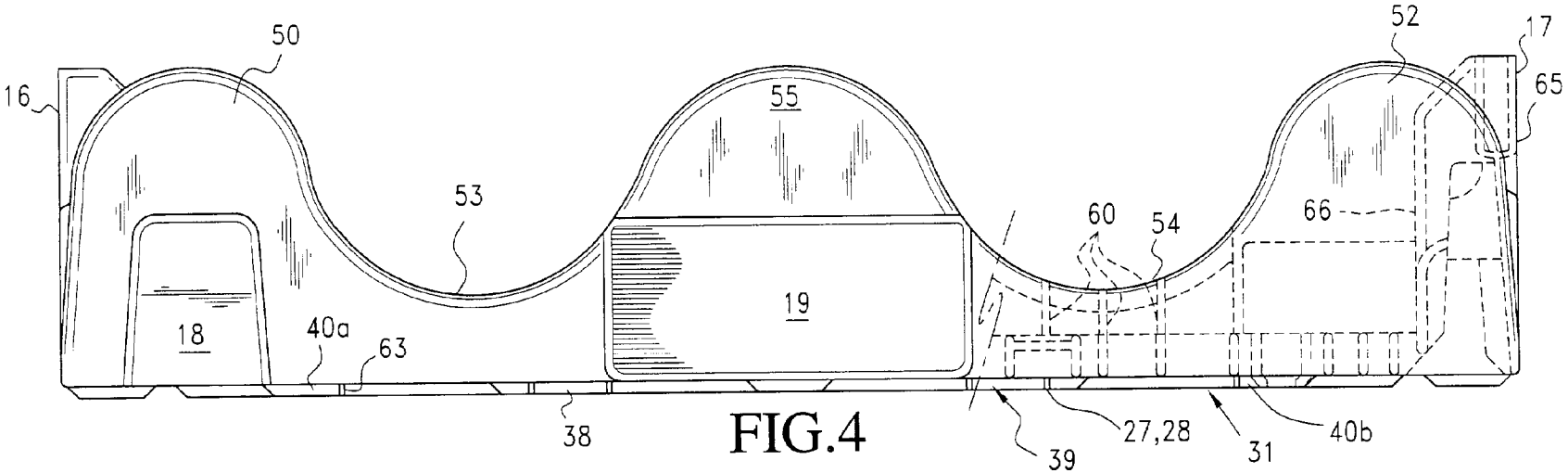
FIG. 4 is a side view in elevation thereof.
Figure 5:
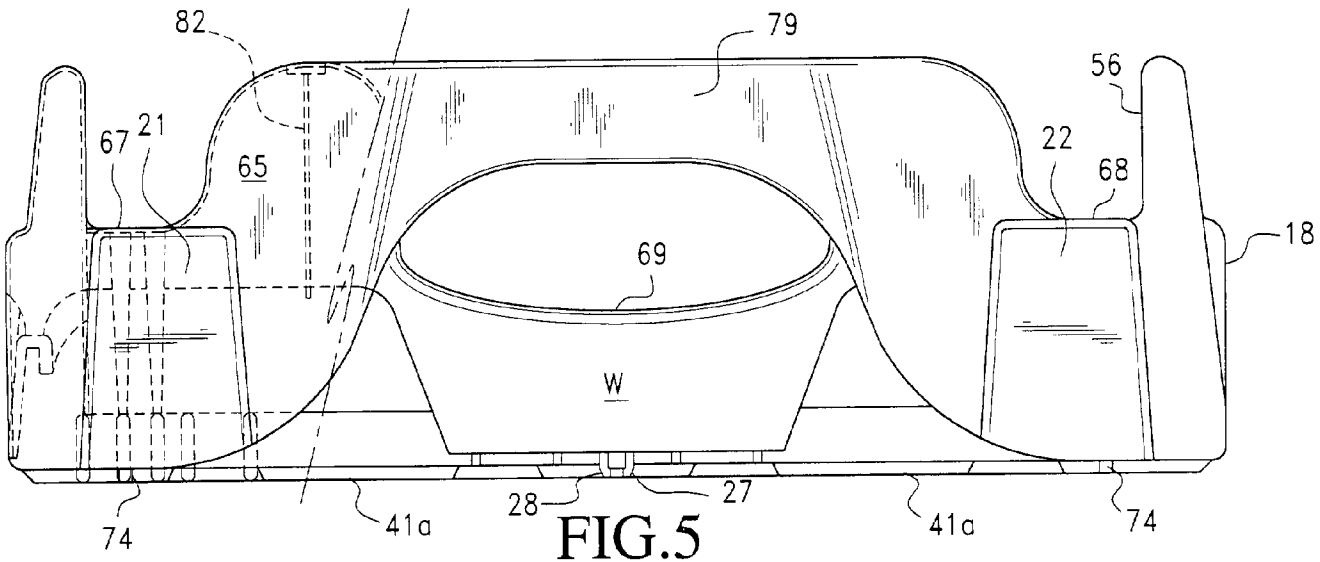
FIG. 5 is an end view in elevation thereof.
Figure 6:
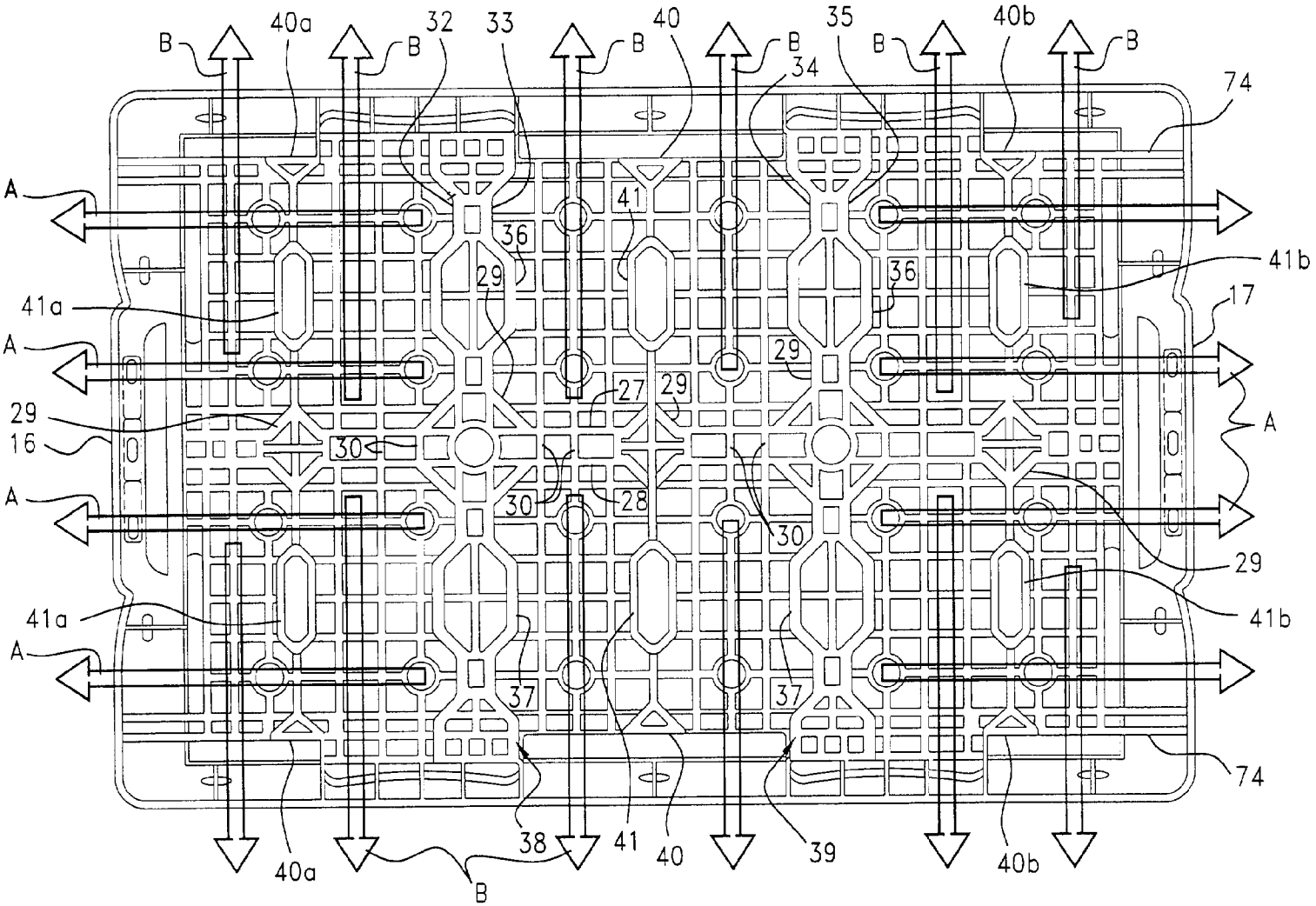
FIG. 6 is a bottom plan view thereof.
Figure 7:
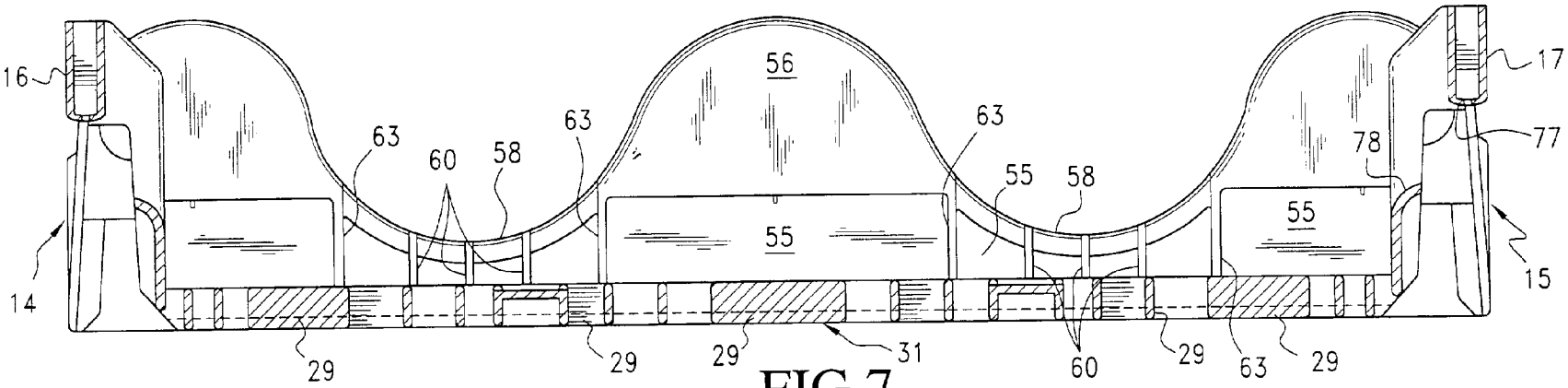
FIG. 7 is an enlarged longitudinal sectional view taken along line 7—7 in FIG. 6.
Figure 8:
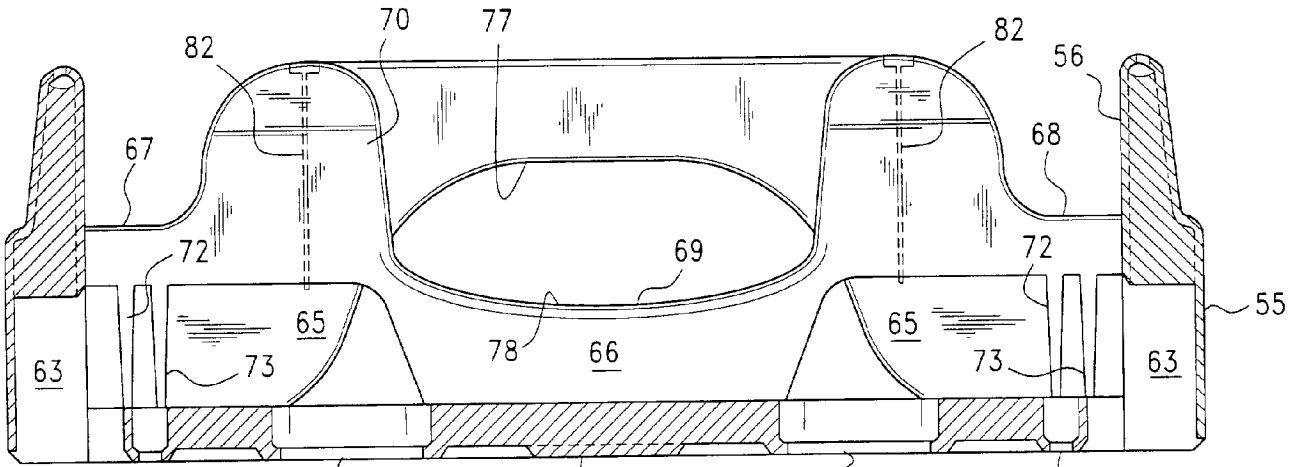
FIG. 8 is an enlarged transverse sectional view taken along line 8—8 in FIG. 6.
Figure 9:
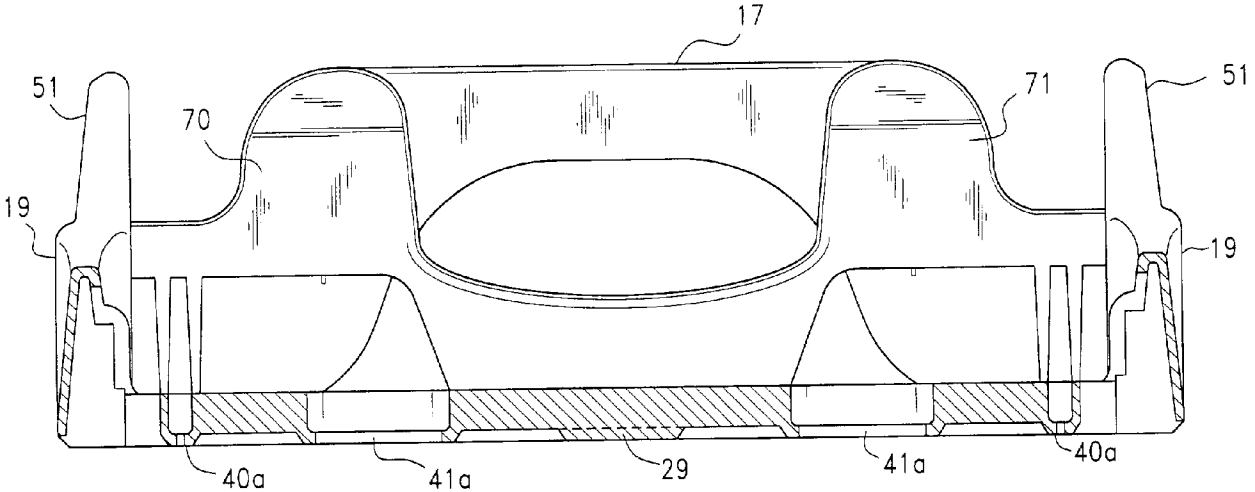
FIG. 9 is an enlarged transverse sectional view taken along line 9—9 in FIG. 6.
Figure 10:
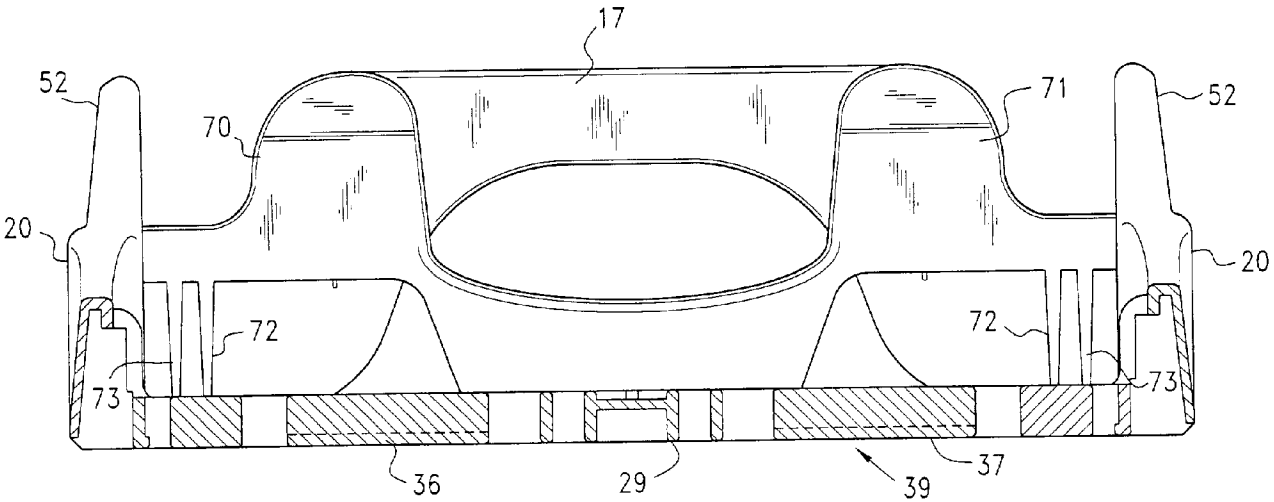
FIG. 10 is an enlarged transverse sectional view taken along line 10—10 in FIG. 6.
Figure 11:
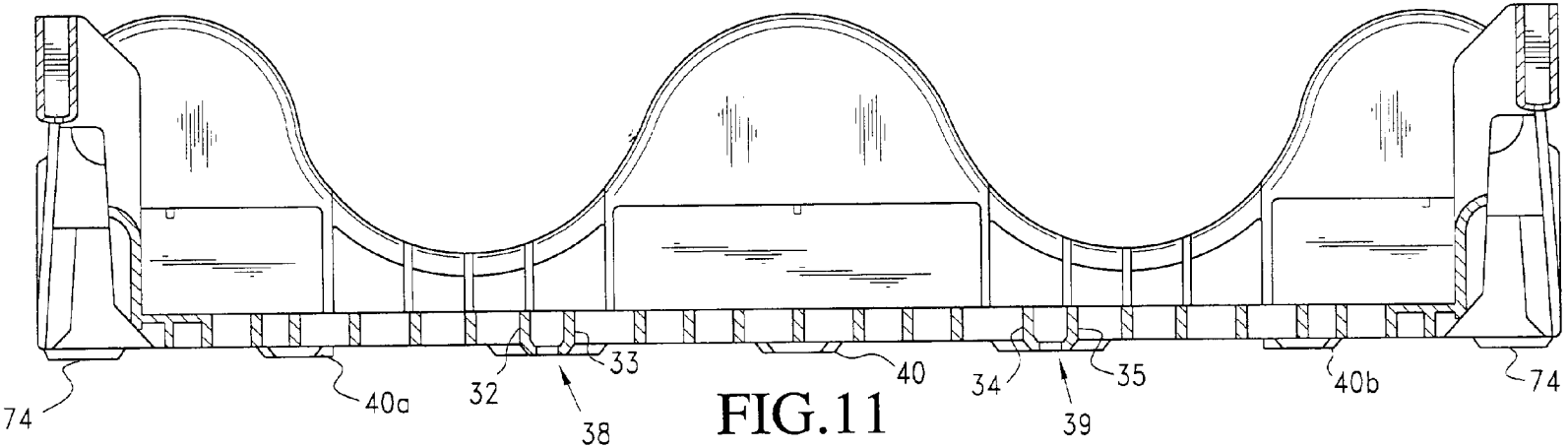
FIG. 11 is an enlarged longitudinal sectional view taken along line 11—11 in FIG. 6.
Figure 12:
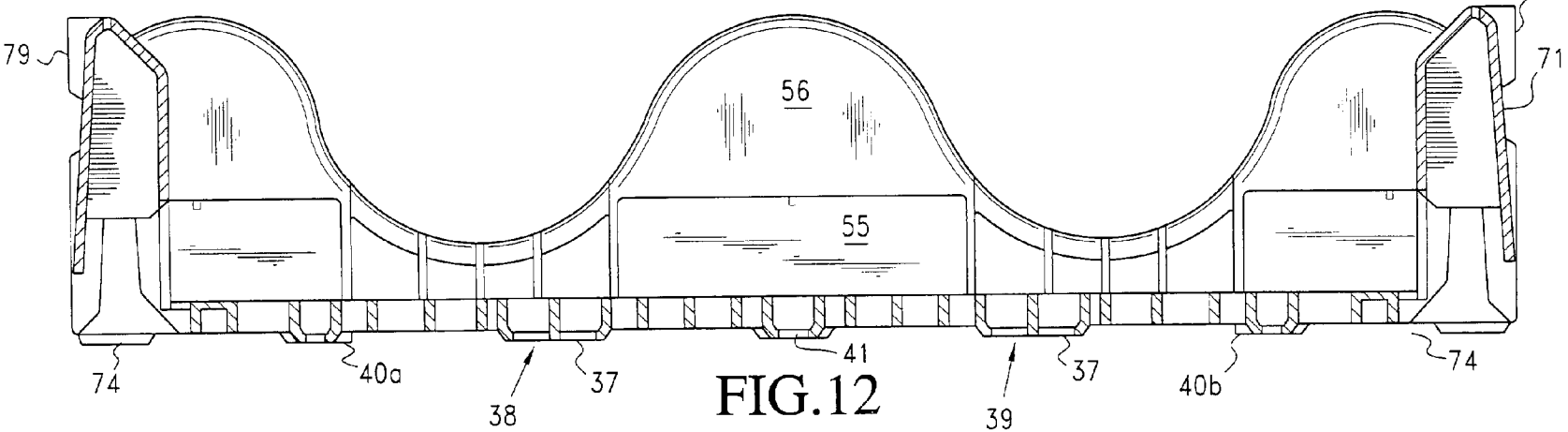
FIG. 12 is an enlarged longitudinal sectional view taken along line 12—12 in FIG. 6.
Figure 15:
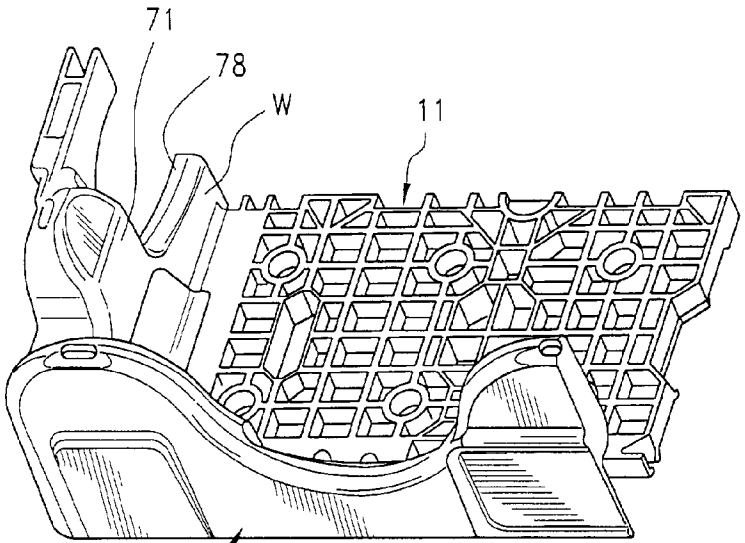
FIG. 15 is an enlarged fragmentary perspective view taken at a different angle than the view shown in FIG. 14, and showing portions of the inside of one end of the tray, and the outside of an adjacent side.
Figure 13:
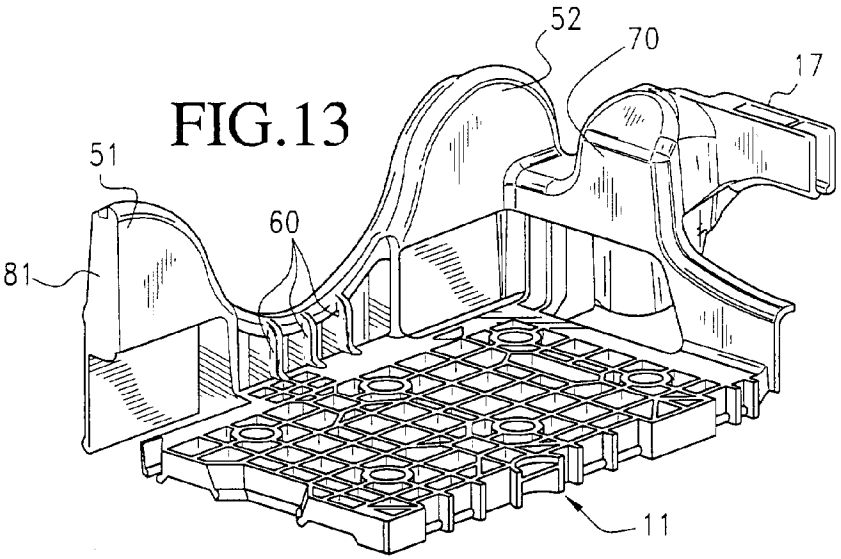
FIG. 13 is an enlarged fragmentary perspective view showing an inside portion of one corner of the tray of the invention.
Figure 14:
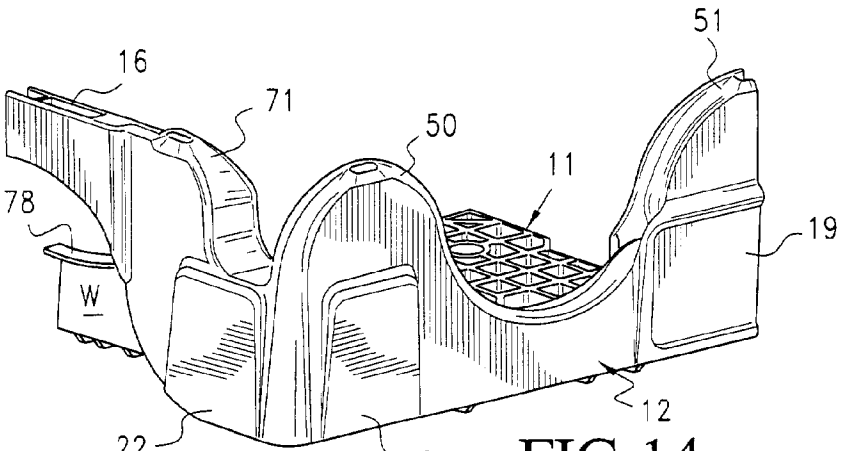
FIG. 14 is an enlarged fragmentary perspective view of an outside portion of an opposite corner of the tray.

The foregoing arrangement of detents form open channels extending from the continuous longitudinal and transverse lines of detents through the adjacent side or end, respectively, of the tray bottom, as represented by the arrows "A" and "B" in FIGS. 2 and 6, permitting easy removal of a tray from a stack of trays. At the same time, the upper ends of at least approximately one half of the bottles in a lower tray are engaged behind detents in an upper tray, whether the trays are stacked in parallel relationship or cross-stacked, thus lending stability to a stack of the trays when loaded with beverage containers, and yet permitting easy removal of a tray from the stack when desired.

The side and end walls are integrally formed with the floor and extend continuously around its periphery. The side walls 12 and 13 are sinusoidally shaped at their upper edge, defining three upper, rounded upper wall sections 50, 51 and 52, with deep cut-outs or recesses 53 and 54 therebetween. Two of the upper wall sections 50 and 52 are located at opposite ends of the respective side walls, and the third upper wall section 51 is located at the middle of a respective side wall. The recesses 53 and 54 are located so that a substantial portion of the sides of six-packs, or the sides of bottles placed loosely in the tray, are visible through the recesses.

Each side wall comprise an outer wall panel 55 that is continuous and planar over the length and height of the side wall, and slightly inwardly inclined from the bottom to the top.

Only the upper wall sections 50, 51 and 52 have inner wall panels 56, which extend downwardly from the tops of the upper wall sections to a bottom edge 57 spaced above the bottoms of the recesses 53 and 54. The inner wall panels 56 on the upper wall sections are coplanar with one another, and lie in a plane that is substantially perpendicular to the plane of the tray floor.

The upper edge of the outer wall panel 55, in the area of the recesses 53 and 54, is turned inwardly and then downwardly to define a rounded upper edge 58 at the bottoms of the recesses.

A plurality of reinforcing ribs 60 extend laterally between outwardly projecting edge portions 61 and 62 of the tray floor and the inner surface of the outer side wall panel 55, and vertically from the lower surface of the tray floor upwardly to the rounded edge 58 at the bottoms of the recesses 53 and 54. Similar, but somewhat heavier reinforcing ribs 63 extend laterally between outer end edge portions of the projecting bottom wall portions 61 and 62 and the inner surface of outer side wall panel 55, and vertically from the bottom surface of the tray floor upwardly to respective opposite bottom end edges of the inner wall panels 56.

Each of the reinforcing ribs 63 projects at its bottom edge downwardly below the plane of the bottom surface of the tray floor and form extensions of the detents 40*a*, 40*b* and 38, 39, respectively, from the adjacent edge of the tray floor to the outer side wall panel 55. The outer corners of these extensions are beveled to prevent snagging and to facilitate introduction of tray handling equipment beneath the tray.

Each tray end wall 14 and 15 comprises an inwardly inclined outer end wall panel 65 and an inner end wall panel 66 extending perpendicular to the tray floor. The upper edge of each end wall is recessed at 67 and 68 at its opposite edges, and at 69 over a substantial mid-portion thereof, defining two upper end wall sections or pillars 70 and 71. The inner end wall panel is omitted in the areas beneath the recesses 67 and 68, leaving a web connected between the adjacent end of the tray floor and the respective end wall. Pairs of reinforcing ribs 72, 73 extend between opposite end edges of the tray floor and the inner surface of the outer end wall panel 65, and upwardly from the tray floor to the bottoms of the recesses 67 and 68. The bottom edge 74 of the outermost rib 73 projects below the plane of the bottom of the tray floor and is coplanar with the bottoms of the detents 26, while the bottom edge of the innermost rib 72 is cut away at 75 over most of its height.

The handles 16 and 17 at the top edge of the respective tray end walls 14 and 15 extend over a substantial portion of the length of the tray end wall and are slightly outwardly offset relative to the end wall. The handles extend between upper ends of the end wall pillars 70 and 71, and are of double wall construction open at the top and closed at the bottom edge 76.

The outer end wall panels 65 are omitted in the area beneath the handles, defining a large opening 77 through which a route driver or other person can insert his or her hand in a palm up position to freely grasp the handle. Additionally, the top edge 78 of the inner wall panel or web is widened or rounded to facilitate palm-down grasping of this structure.

During machine handling of trays, and especially during use of a de-stacking or de-nesting machine, the machine (not shown) has portions that grip the outside of the tray to hold it and manipulate it. To facilitate this machine handling, the tray of the invention has several spaced, strategically placed, generally rectangular pads 18, 19 and 20 on the outer side wall surfaces, and pads 21 and 22 on the outer end wall surfaces, with the outer surfaces of the pads being substantially flat and lying in respective common planes that are substantially perpendicular to the plane of the tray floor. More specifically, pads 18 and 20 are formed on the outer surfaces of each side wall at the location of the upper side wall sections 50 and 52 at the opposite ends of the side walls, and a pad 19 is formed on the outer surface of each of the upper side wall sections 51 at the midpoint of each side wall. The pads extend upwardly from the bottom of the tray to approximately mid-height of the respective upper side wall sections.

Similar pads 21 and 22 are also formed on each end wall in the areas beneath the cut-outs or recesses 53 and 54, extending upwardly from the bottom edge of the end wall to the bottoms of the cut-outs. The outer surface of the handle is built outwardly to define a further pad 79 extending over substantially the entire outer surface of the handle. Accordingly, the outer surface of each side wall and of each end wall has three flat pads to facilitate handling with automated machinery.

The provision and arrangement of pads on the outer surface of the tray side walls to facilitate handling with automated equipment lends greater flexibility to the design of the tray, and especially to the design of the tray side and end walls.

Figure 17:
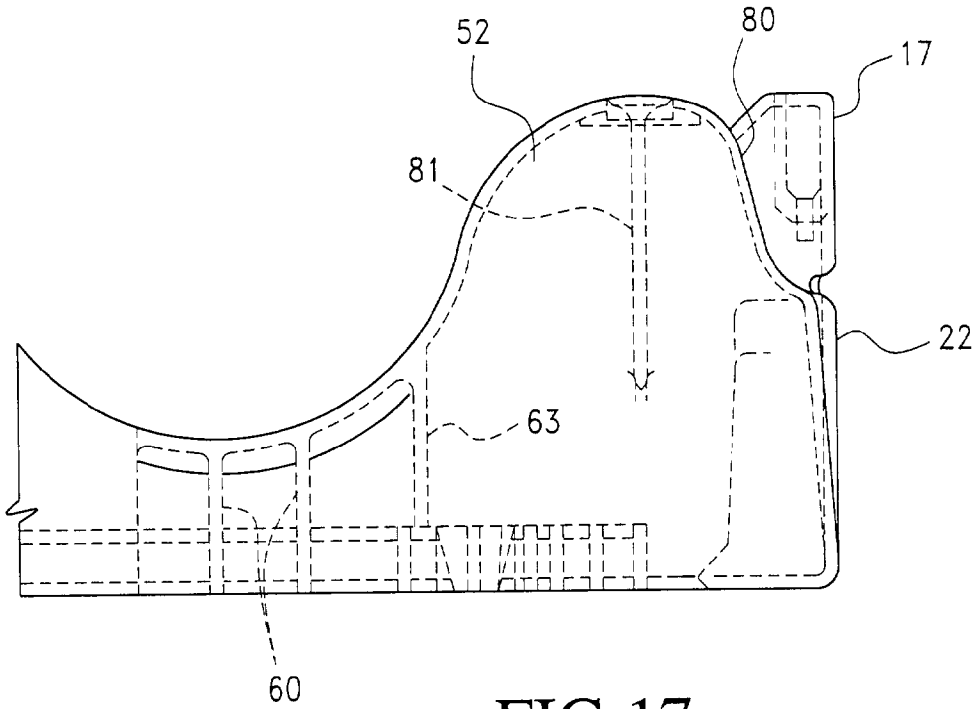
FIG. 17 is a view similar to FIG. 16, showing an alternate shape of the curvature of the endmost side wall sections, relieved to accommodate machinery in the filing line.
Figure 16:
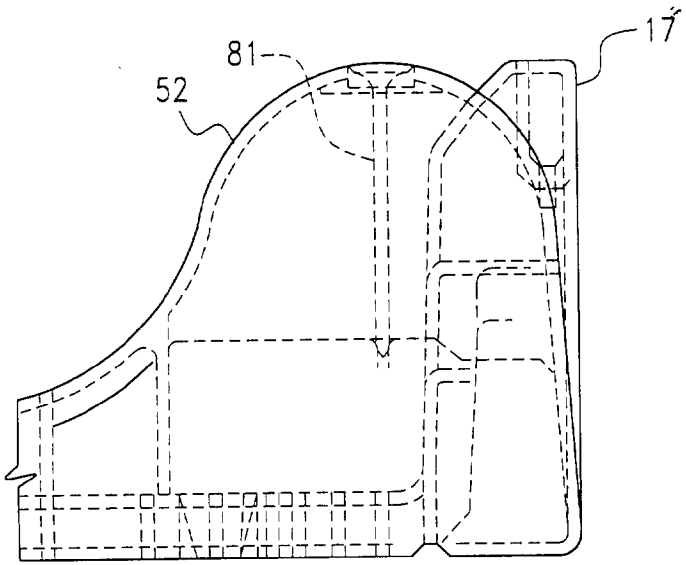
FIG. 16 is an enlarged fragmentary view in side elevation of one end of the side wall of the tray of the invention, showing the shape of the curvature of the endmost side wall sections in one form of the invention.

As seen in FIG. 17, the outer end shoulders on the upper wall sections 50 and 52 at opposite ends of the tray side walls are cut away at 80 to accommodate automated machinery on the filling line (only upper wall section 52 and its associated cut-away shoulder are shown, it being understood that the same cut-away structure is provided at each corner of the tray).

Figure 18:
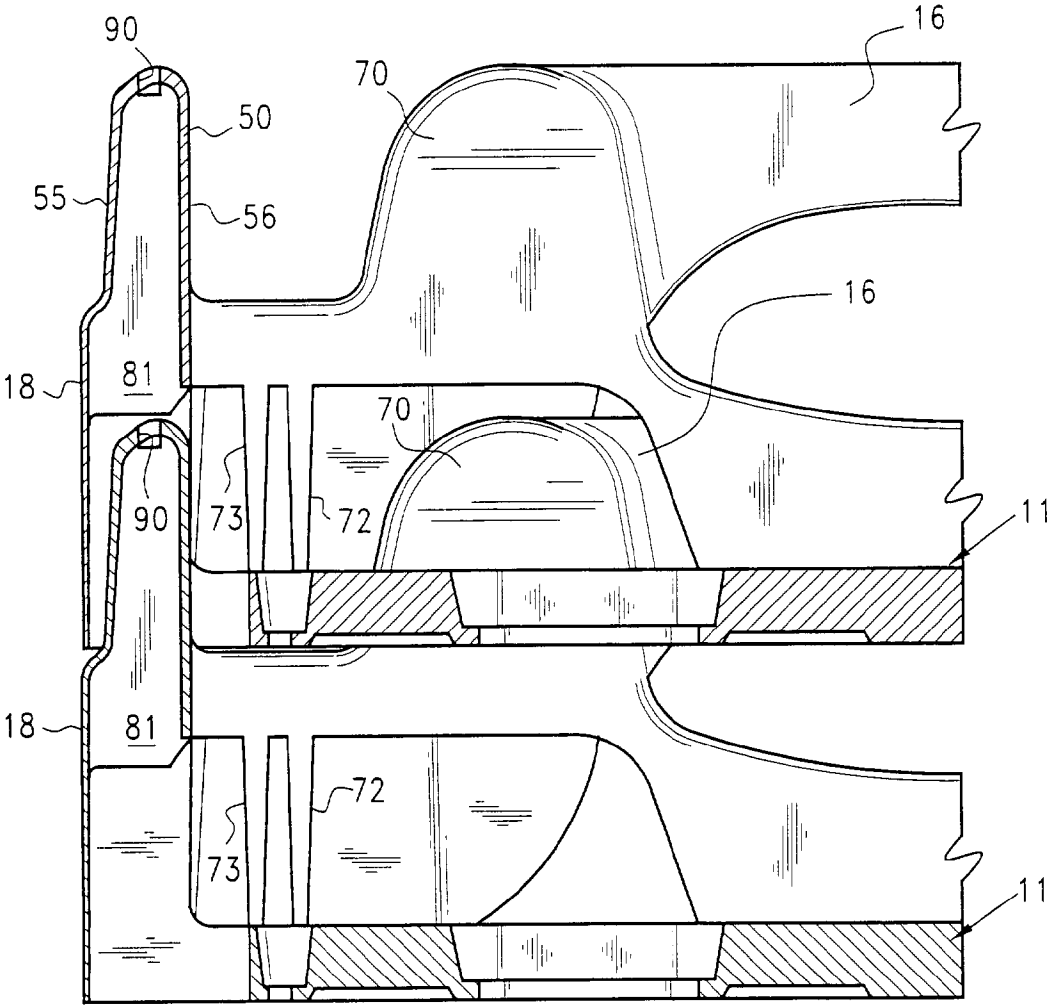
FIG. 18 is a fragmentary, transverse sectional view showing a pair of trays nested together.
Figure 20:
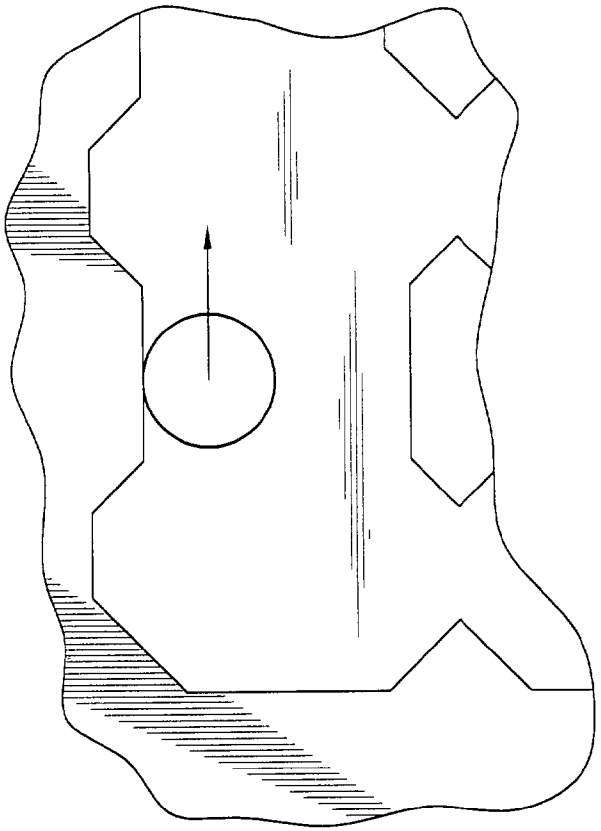
FIG. 20 is a fragmentary schematic view showing how the rectilinear detents of the invention present parallel surfaces to the bottle tops on opposite sides of a bottle top receiving "pocket".
Figure 19:
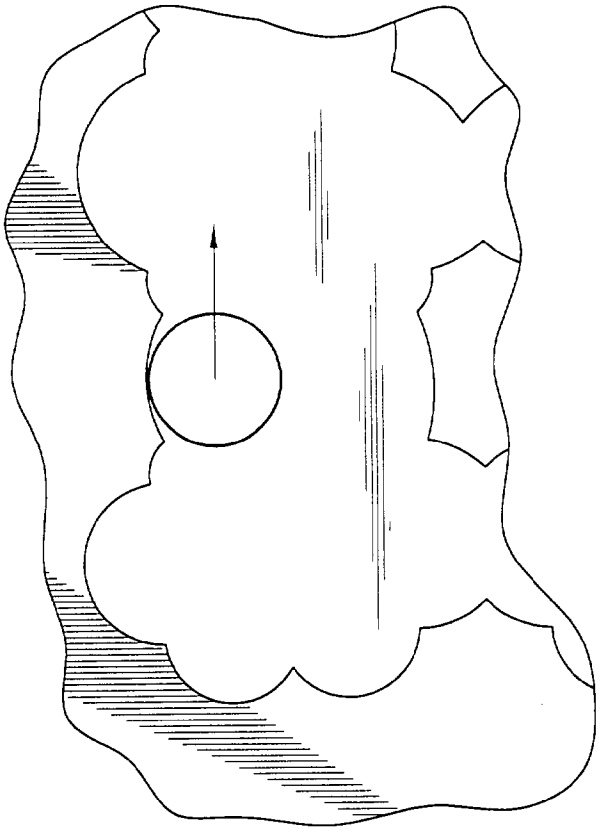
FIG.19 (PRIOR ART)
FIG. 19 is a fragmentary schematic view showing in full lines two opposed concave curvilinear detents, and in broken lines two opposed convex curvilinear detents, and depicting how these opposed curvilinear detents may cooperate to "lock" bottles against unimpeded movement.

A pair of trays nested on top of one another are shown in FIG. 18. When nested, the rounded upper ends of the upper wall sections 50, 51 and 52 of the lower tray are received in the open lower edges of the side walls of the upper tray, and that portion of the end walls extending above the end wall recesses 67 and 68, including the handle structures 16 and 17, are received in the open lower edges of the end walls.

To prevent wedging together of the trays when they are stacked in nested relationship, and to rigidify the wall structure, a rib 81 extends between the outer and inner wall panels 55 and 56 at the vertical centerline of each upper side wall section 50, 51 and 52, extending from just below the bottom edge of the inner side wall panel 56 to the top of the respective upper side wall section. In addition, ribs 82 extend between the outer and inner end wall panels 65 and 66 at the vertical centerline of each end wall pillar 70 and 71, extending from just below the bottom edge of the inner end wall panel to the top of each pillar. When the trays are nested together, the tops of the upper side wall sections in a lower tray engage the bottom edges of ribs 81 in an upper tray to prevent the trays from nesting so deep that the upper side wall sections of the lower tray become wedged in the hollow side walls of the upper tray. It will be noted that when two trays are nested together, the bottom edge of the outer side wall panel of an upper tray lies just above the top edge of the pads 18, 19, 20, 21 and 22.

In order to permit drainage of any water that might enter into the cavity formed between the inner and outer wall panels of the side and end walls, a small opening 90 is formed through the top of each upper side wall section and each end wall pillar.

While particular embodiments of the invention have been illustrated and described in detail herein, it should be understood that various changes and modifications may be made to the invention without departing from the spirit and intent of the invention as defined by the scope of the appended claims.

What is claimed is:

1. A beverage tray for holding a quantity of containers of beverage, said tray comprising:

a tray floor having a transverse direction and a longitudinal direction, opposite side edges and opposite end edges, a top surface and a bottom surface and a plurality of spaced apart beverage container seating areas distributed over the top surface;

upstanding side and end walls extending upwardly from the floor and around the periphery of the floor for confining beverage containers supported on the floor; and spaced rectilinear detent means projecting downwardly from the underside of the tray floor a predetermined distance and presenting pairs of opposed, parallel, straight detent surfaces forming closure receiving areas for receiving the tops of beverage containers in a sub-adjacent tray when a plurality of trays holding containers of beverage are stacked on top of one another, said detent means forming unimpeded transverse and longitudinal channels that open through adjacent side and end edges of the tray, said detent means and channels cooperating with the tops of said beverage containers to impede free sliding movement of one tray over the tops of the beverage containers so that the trays can be stacked together in stable relationship, but at the same time enabling said one tray to be moved transversely or longitudinally with respect to the sub-adjacent tray when a laterally directed force is applied to said one tray to remove it from the stack of trays.

2. A beverage tray as claimed in claim 1, wherein:

said tray floor comprises a plurality of parallel, uniformly spaced apart, longitudinally and transversely extending orthogonally intersecting struts defining an open grid of rectangular configuration; and at least some of said detent means are formed on the underside of said struts.

3. A beverage tray as claimed in claim 2, wherein:

said detent means include rectilinear formations supported by said transversely and longitudinally extending struts and having predetermined lengths in directions parallel to the plane of the tray floor and predetermined depths in a direction perpendicular to the plane of the tray floor.

4. A beverage tray as claimed in claim 3, wherein:

said detent means comprise a plurality of detent sets distributed over the bottom surface of the tray floor, with a detent set disposed beneath each beverage container seating area, and each detent set defining a plurality of opposed pairs of parallel, straight detent sides.

5. A beverage tray as claimed in claim 4, wherein:

said detent means include a first continuous, uninterrupted detent line extending along the longitudinal centerline of the tray bottom.

6. A beverage tray as claimed in claim 5, wherein:

said detent means include second and third continuous, uninterrupted detent lines extending along respective transverse lines extending parallel to one another on opposite equally spaced sides of the transverse centerline of the tray.

7. A beverage tray as claimed in claim 6, wherein:

said detent means includes a fourth line of spaced rectilinear detents extending along the transverse centerline of the tray, and fifth and sixth lines of spaced rectilinear detents lying along parallel transverse lines equidistantly spaced, respectively, on opposite sides of said second and third uninterrupted detent lines.

8. A beverage tray as claimed in claim 7, wherein:

said lines of spaced detents and said lines of uninterrupted detents cooperate to define a plurality of said open channels free of detents extending transversely through opposite side edges of the tray from the longitudinal centerline thereof, and a plurality of said open channels free of detents extending longitudinally through opposite ends of the tray from the second and third lines, respectively, of uninterrupted detents.

9. A beverage tray as claimed in claim 8, wherein:

the upper edges of the side walls are smoothly sinusoidally curved to define a plurality of alternating upper side wall sections and recessed areas.

10. A beverage tray as claimed in claim 9, wherein:

the side walls comprise an inwardly inclined, planar outer side wall panel, and inner side wall panels on only the upper side wall sections, said inner side wall panels being perpendicular to the tray floor.

11. A beverage tray as claimed in claim 10, wherein:

the upper edge of the end walls is recessed at opposite side edges thereof and across a substantial mid-portion, defining a pair of spaced apart upper end wall sections, said end wall having an inwardly inclined planar outer end wall panel, and inner end wall panels on only the upper end wall sections.

12. A beverage tray as claimed in claim 11, wherein:

a plurality of spaced apart flat pads are on the outer side and end wall panels for machine handling of the tray.

13. A beverage tray as claimed in claim 12, wherein:

one of said pads is located on an outer surface of each upper section of said side and end wall panels, said pads extending from a bottom edge of the respective side and end wall outer panel to a position spaced above the bottom of said recessed areas but below the top of said upper side and end wall sections.

14. A beverage tray as claimed in claim 13, wherein:

a handle extends between the upper ends of said upper end wall sections.

15. A beverage tray for holding a quantity of containers of beverage, said tray comprising:

a tray floor having transverse and longitudinal dimensions, side edges and end edges, a top surface and a bottom surface;

upstanding side and end walls extending upwardly from the floor and around the periphery of the floor for confining beverage containers supported on the floor, upper edges of the side walls being smoothly sinusoidally curved to define a plurality of alternating upper side wall sections and recessed areas, and said side walls comprising an inwardly inclined, planar outer side wall panel extending from a bottom edge to the upper edge, and inner side wall panels on only the upper side wall sections, said inner side wall panels being perpendicular to the tray floor; and a plurality of raised, spaced apart flat pads on the outer side and end wall panels, extending substantially perpendicular to the plane of the tray floor and outwardly offset from the plane of their respective outer side and end wall panels, for machine handling of the tray.

16. A beverage tray as claimed in claim 15, wherein:

said pads on the side wall panels are coplanar with one another and the pads on the end wall panels are coplanar with one another.

17. A beverage tray as claimed in claim 16, wherein:

one of said pads is located on an outer surface of each upper section of said side and end wall panels, said pads extending from a bottom edge of the respective side and end wall outer panel to a position spaced above the bottom of said recessed areas but below the top of said upper side and end wall sections.

18. A beverage tray as claimed in claim 17, wherein:

spaced rectilinear detent means project downwardly from the underside of the tray floor a predetermined distance and present pairs of opposed, parallel, straight detent surfaces forming pockets for receiving the tops of beverage containers in a sub-adjacent tray when a plurality of trays holding containers of beverage are stacked on top of one another, said detent means forming unimpeded transverse and longitudinal channels that open through adjacent side and end edges of the tray, said detent means cooperating with the tops of said beverage containers to impede free sliding movement of one tray over the tops of the beverage containers so that the trays can be stacked together in stable relationship, but at the same time enabling said one tray to be moved transversely and longitudinally with respect to the sub-adjacent tray when a laterally directed force is applied to said one tray to remove it from the stack of trays.

19. A beverage tray as claimed in claim 18, wherein:

said tray floor comprises a plurality of parallel, uniformly spaced apart, longitudinally and transversely extending orthogonally intersecting struts defining an open grid of rectangular configuration; and at least some of said detent means are formed on the underside of said struts.

20. A beverage tray as claimed in claim 19, wherein:

said detent means include rectilinear formations supported by said transversely and longitudinally extending struts and having predetermined lengths in directions parallel to the plane of the tray floor and predetermined depths in a direction perpendicular to the plane of the tray floor.

21. A beverage can tray as claimed in claim 20, wherein:

said detent means comprise a plurality of detent sets distributed over the bottom surface of the tray floor, with a detent set disposed around each pocket, and each detent set defining a plurality of opposed pairs of parallel, straight detent sides.

22. A beverage tray as claimed in claim 21, wherein:

said detent means include a first continuous, uninterrupted detent line extending along the longitudinal centerline of the tray bottom.

23. A beverage tray as claimed in claim 22, wherein:

said detent means include second and third continuous, uninterrupted detent lines extending along respective transverse lines extending parallel to one another on opposite equally spaced sides of the transverse centerline of the tray.

24. A beverage tray as claimed in claim 23, wherein:

said detent means includes a fourth line of spaced rectilinear detents extending along the transverse centerline of the tray, and fifth and sixth lines of spaced rectilinear detents lying along parallel transverse lines equidistantly spaced, respectively, on opposite sides of said second and third uninterrupted detent lines.

25. A beverage tray as claimed in claim 24, wherein:

said lines of spaced detents and said lines of uninterrupted detents cooperate to define a plurality of said pathways free of detents extending transversely through opposite side edges of the tray from the longitudinal centerline thereof, and a plurality of said pathways free of detents extending longitudinally through opposite ends of the tray from the second and third lines, respectively, of uninterrupted detents.

* * * * *